United States Patent [19]

Phelan

[11] Patent Number: 4,638,970

[45] Date of Patent: Jan. 27, 1987

[54] HIGH HAT LIGHT FIXTURE SUPPORT BRACKET

[75] Inventor: Gerard Phelan, Stony Point, N.Y.

[73] Assignee: Swivelier, Nanuet, N.Y.

[21] Appl. No.: 764,569

[22] Filed: Aug. 12, 1985

[51] Int. Cl.[4] ..... B42F 13/00

[52] U.S. Cl. ..... 248/342; 248/323; 362/406; 362/418; 362/430

[58] Field of Search ..... 248/342, 343, 344, 323, 248/327, DIG. 6, 295.1, 297.2; 362/418, 430, 433, 449, 406, 408

[56] References Cited

U.S. PATENT DOCUMENTS

| | | | |
|---|---|---|---|
| 2,963,255 | 12/1960 | Bobrick | 248/327 |
| 3,012,132 | 12/1961 | Rosenfield | 248/343 X |
| 3,356,840 | 12/1967 | Cohen | 248/343 X |
| 3,700,885 | 10/1972 | Bobrick | 248/343 X |
| 4,180,850 | 12/1979 | Bivens | 362/418 X |

FOREIGN PATENT DOCUMENTS

| | | | |
|---|---|---|---|
| 0518118 | 11/1929 | Netherlands | 362/418 |

*Primary Examiner*—Ramon O. Ramirez

*Attorney, Agent, or Firm*—Ostrolenk, Faber, Gerb & Soffen

[57] ABSTRACT

A height adjustable light fixture support includes a first U-shaped bracket with a crosspiece and first and second depending legs. The U-shaped bracket will be secured in a ceiling box. A slidable, height adjustable second U-shaped bracket supports a light and includes separated first and second plates, each of which is shaped to define a respective sliding channel in which one of the legs of the first bracket is slidably receivable. The plates are connected by a second crosspiece. Spring loaded members supported by each plate each include a spherical head which penetrates into the sliding channel of its plate to frictionally engage the respective leg of the first bracket in the channel. Temporary release of these members enables the height of the light fixture to be easily adjusted by moving the second bracket.

11 Claims, 6 Drawing Figures

HIGH HAT LIGHT FIXTURE SUPPORT BRACKET

BACKGROUND OF THE INVENTION

The present invention relates to a height adjustable support for a high hat light fixture.

Light fixtures are often supported at the ceiling of a room. Sometimes the fixtures are installed in a recess in the ceiling. When the recess and the installed fixture are circular, the combination is often referred to as a high hat fixture. The sizes of or the desired heights and positions of various light fixtures in high hats may vary. It is therefore advantageous to allow an installer or user to adjust the height of a light fixture with respect to its high hat fixture recess.

Bobrick, U.S. Pat. No. 2,963,255, discloses an adjustable height light fixture, except that only one-half of a U-shaped bracket is shown, rather than an entire U-shaped bracket. Bobrick's device includes a fixed bracket and a movable bracket which slides up and down in a groove defined in the wall of the fixed bracket. The friction connection between the two brackets permits the movable bracket and the light fixture supported on the movable bracket to be shifted in height along the fixed bracket.

Bobrick's adjustable light fixture requires provision of a groove in the fixed bracket. Moreover, the connection between the two brackets uses a spring clip which make Bobrick's device complicated and not sturdy.

Other prior art also relating to the subject of the present invention include U.S. Pat. Nos. 2,914,287; 2,936,991; 3,313,931; 3,885,147; 3,941,995; 4,139,882; 4,361,992; 4,385,550; 4,419,717; and 4,449,168. However, none of these suggest the fixture with relatively slidable height adjustment brackets of the present invention.

SUMMARY OF THE INVENTION

Accordingly, it is an object of the present invention to provide an adjustable light fixture support which is very simple in construction and is sturdy.

It is another object of the invention to provide an adjustable height light fixture whose height can be adjusted without tools.

The foregoing and other objects are realized with a height adjustable light fixture support which includes a first generally U-shaped bracket, including a first crosspiece and first and second parallel, depending, elongate legs. The bracket will be immovably secured in an ordinary, ceiling-mounted, light fixture box in which a high hat fixture is installed. Typically, that box is installed in a recess in a ceiling.

The support includes a second generally U-shaped bracket. Each one of a pair of plates that define the legs of the second bracket is shaped to define a respective sliding channel for slidingly receiving one of the legs of the first bracket. The two plates are connected by a second crosspiece having a length to support the plates on the legs of the first bracket. The second bracket can slide up and down the legs of the first U-shaped bracket. A light fixture is connected to the crosspiece of the second bracket.

One or more spring loaded members mounted to each plate penetrate into the sliding channel of the plate and press against the respective leg of the first bracket to frictionally engage that leg and to thus fix the position of the second bracket with respect to the first bracket.

Other features and advantages of the present invention will become apparent from the following description of a preferred embodiment of the invention and the accompanying drawings.

DETAILED DESCRIPTION OF A PREFERRED EMBODIMENT

Figure 1:
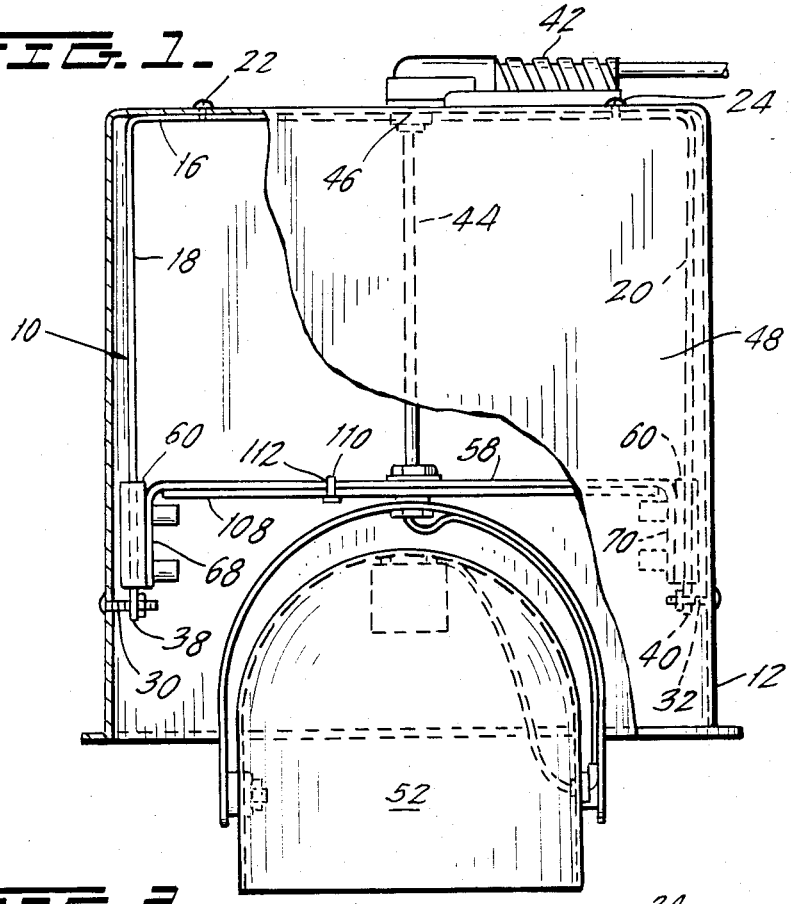
FIG. 1 is a cross-section through the light fixture support of the present invention and also illustrates the manner in which a light fixture is connected to the support.
Figure 2:
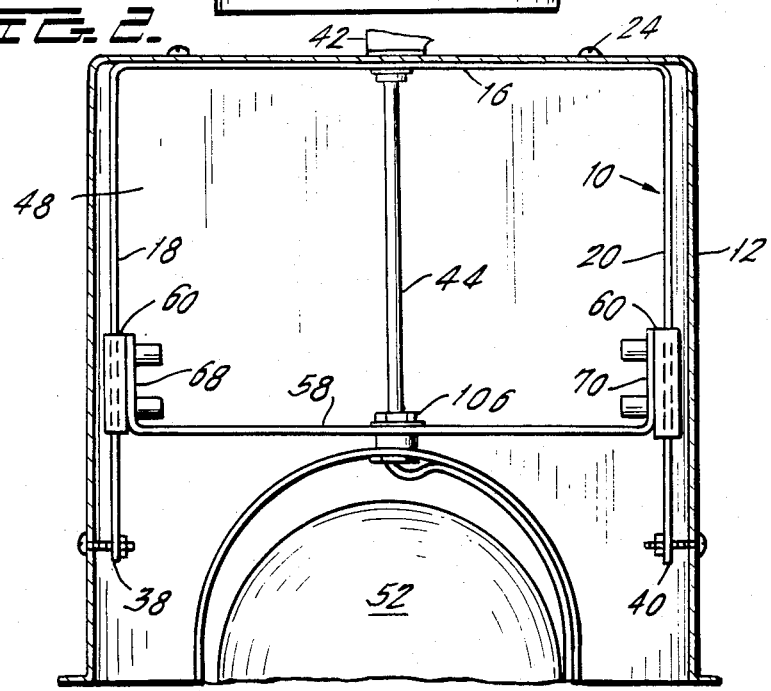
FIG. 2 is a view similar to FIG. 1 but shows an inverted orientation for the second bracket of the support.
Figure 3:
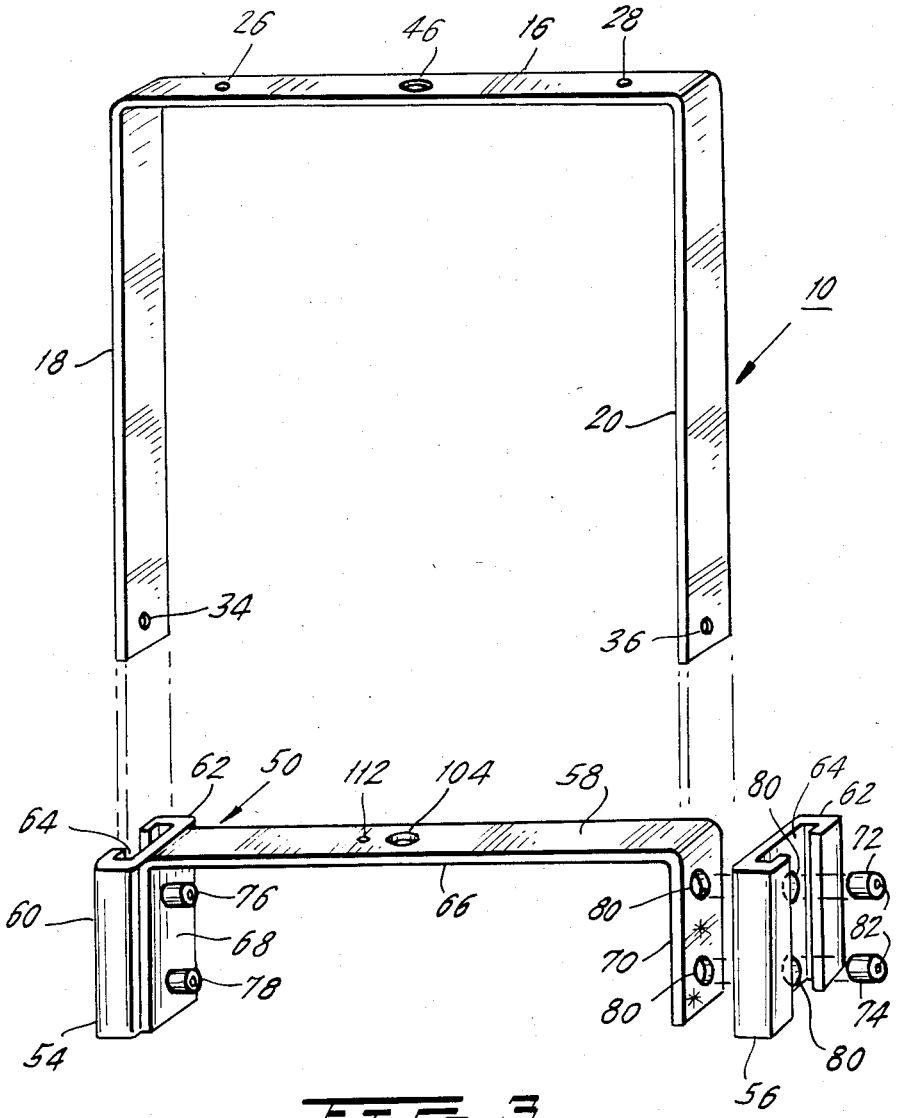
FIG. 3 is a perspective of the fixture support of the present invention.

Referring to FIGS. 1–3, the height adjustable light fixture support there illustrated includes a first U-shaped bracket 10 which will be secured to a high hat fixture box 12 or directly to a wall structure in a recess in a room ceiling (not shown). The bracket 10 includes a crosspiece 16 and first and second parallel, depending, elongate legs 18 and 20. The crosspiece 16 is secured to the fixture box 12 by bolts 22 and 24 which engage threaded holes 26 and 28 in the crosspiece 16. The legs 18 and 20 of the bracket 10 are radially spaced inwardly from the peripheral wall of the box 12 and are secured to the wall of the box by bolts 30 and 32 which pass through holes 34 and 36 that are positioned toward the free ends 38 and 40 of the legs 18 and 20. The bolts serve as stops for a second bracket 50, as described below.

Jacket 42 of an electrical cable 44 is secured at the cable receiving hole 46 in the crosspiece 16 of the bracket 10. Conductors of the cable 44 pass through the hole 46 into the interior 48 of the box 12.

A light fixture height adjustment, slidable, second, generally U-shaped bracket 50 frictionally engages and slides along the legs 18 and 20 of the bracket 10. A light fixture 52 is connected to the bracket 50 and the height of the light fixture 52 with respect to the box 12 is determined by fixing the position of the second bracket 50.

Referring to FIG. 3, the bracket 50 includes spaced apart plates 54 and 56, which are welded or riveted to the short arms 68 and 70 depending from a second crosspiece 58. Each plate is a generally rectangular piece of metal whose sides 60 and 62 are reentrantly bent to define a sliding channel 64 which is generally shaped to slidingly receive a respective one of the legs 18 and 20 of the first bracket 10.

Spring loaded members 72 and 74 on the right side and 76 and 78 on the left side are fitted in support holes 80. The spring loaded members include spring biased heads 82 which bear against the legs 18 and 20 of the first bracket 10 to frictionally engage them and fix the position of the slidable second bracket 50 with respect to the legs 18 and 20. The plates 54 and 56 are prevented from sliding off the legs 18 and 20 by the end stop bolts 30 and 32 (FIG. 1).

Also, as shown in FIG. 3, the second crosspiece 66 includes a hole 104 through which the electrical cable 44 passes. A connection member 106 (FIG. 2) can be used to connect the electrical fixture 52 to the crosspiece 66. Alternatively, and as shown in FIG. 1, the fixture may include a connection bar 108 and a bolt 110 which engages a threaded hole 112 in the flange 58.

Figure 4:
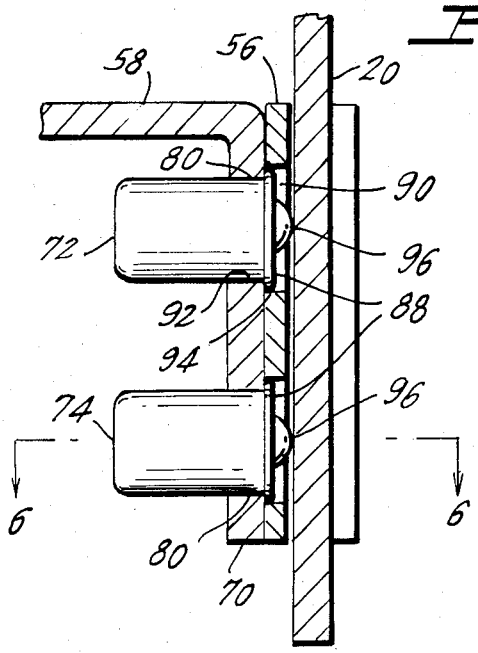
FIG. 4 is a vertical section through a fragment of the second bracket.
Figure 5:
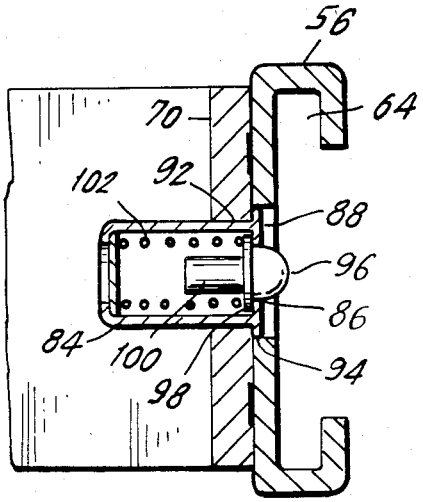
FIG. 5 is a transverse section through a plate of the second bracket without the first bracket.
Figure 6:
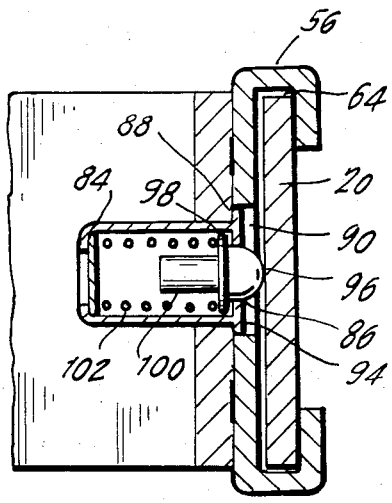
FIG. 6 is a section through the line 6—6 of FIG. 4, with the first bracket present.

Referring to FIGS. 4–6, it can be seen that each spring loaded member, for example member 72, includes a can-shaped cylindrical housing 84 with an opening 86 which is bound by a ring-like border 88. A cylindrical opening 90 through the respective plate 54 or 56 is larger in diameter than the circular opening 92 through the respective arm 68 or 70. A circular ledge 94 is defined, and the ring-like border 88 of the can 84 is supported by the ledge 94.

A semi-spherical head 96 with base 98 and a stem 100 is located inside the housing 84 and is urged outwardly by a spring 102. The spherical head emerges from the can and extends partially to block the guide channel 64. The base 98 is urged against the ring-like border 88 of the housing by the spring 102 (FIG. 5). However, when the leg 20 of the bracket 10 is inserted into the guide channel 64 as illustrated in FIG. 6, the head 96 is pushed into its housing but still bears frictionally against the leg 20. The position of the slidable second bracket 50 remains fixed with respect to the legs of the bracket 10 through the action of the four spring loaded members which bear against the legs.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A height adjustable light fixture support comprising:

a first generally U-shaped bracket having a first crosspiece and first and second legs depending from the first crosspiece;

a second generally U-shaped bracket, including first and second plates each shaped to define a respective sliding channel in which a respective one of the legs of the first U-shaped bracket is slidingly receivable; a second crosspiece extending between the plates for connecting the plates to one another;

a spring loaded biased member for each plate, the biased member being biased to penetrate into the sliding channel of the plate and to press against the respective leg of the first U-shaped bracket when the leg is inserted into the channel to thereby frictionally secure the plate and the leg to one another.

2. The fixture support of claim 1 in which the second crosspiece is U-shaped and extends between the plates and includes a pair of depending parallel arms which are secured to the first and second plates, respectively; the biased member of each plate penetrating through the arm and the plate into the sliding channel.

3. The fixture support of claim 1 further comprising a high hat light fixture ceiling box into which the fixture support is dimensioned to fit.

4. The fixture support of claim 3, wherein the ceiling box has a peripheral wall and the legs of the first bracket are spaced from and are also attached to the peripheral wall.

5. The fixture support of claim 4, wherein the legs of the first bracket have free ends and the attachment of the first bracket legs to the peripheral wall include a respective bolt at the free end of each leg of the first bracket for securing the bracket to a wall and for preventing the plates from sliding off the first bracket.

6. The fixture support of claim 1, wherein the legs of the first bracket have free ends and further comprising means at the free ends of the legs of the first bracket for preventing the plates from sliding off the first bracket.

7. The fixture support of claim 1, further including means for connecting a light fixture to the second crosspiece.

8. The fixture support of claim 1 in which the second bracket is oriented so that the second crosspiece is located adjacent an end of the first and second plates which is furthest from the first crosspiece.

9. The fixture support of claim 1 in which the second bracket is oriented so that the second crosspiece is located adjacent an end of the plates which is nearest to the first crosspiece.

10. The fixture support of claim 1 in which the spring loaded biased members each comprise a housing secured to the respective plate, a generally semi-spherical head which protrudes from the housing and a spring in the housing which bears against the head in the housing, the head having a base with a larger diameter than a diameter associated with the semi-spherical head such that the base is retained within the housing.

11. The fixture support of claim 1 in which the spring loaded member at each leg is placed in the housing to engage an inner surface of each leg that faces the opposed inner surface on the other leg.

* * * * *